United States Patent [19]

Matras

[11] 3,932,969

[45] Jan. 20, 1976

[54] FERROCEMENT STRUCTURES AND METHOD

[76] Inventor: Thad E. Matras, Box 307, R.D. No. 1, Highland, N.Y. 12528

[22] Filed: Aug. 19, 1974

[21] Appl. No.: 498,582

[52] U.S. Cl. ..... 52/86; 52/454; 264/32

[51] Int. Cl.[2] ..... E04B 1/32

[58] Field of Search ..... 52/86, 88, 89, 63, 222, 52/309, 454; 264/32, 35, 228, 253, 328

[56] References Cited

UNITED STATES PATENTS

| | | | |
|---|---|---|---|
| 2,353,071 | 7/1944 | Pitou | 52/88 |
| 2,948,047 | 8/1960 | Peeler et al. | 52/88 X |
| 3,494,082 | 2/1970 | Adams et al. | 52/86 |
| 3,597,890 | 8/1971 | Hala | 52/86 |
| 3,780,477 | 12/1973 | Sprung | 52/86 |
| 3,798,851 | 3/1974 | Utahara | 52/86 |

*Primary Examiner*—J. Karl Bell

*Attorney, Agent, or Firm*—Harrie M. Humphreys

[57] ABSTRACT

Ferrocement structures and the method for producing them comprising: providing a load-bearing framework, covering the framework with a strong flexible sheet-like material and then a flexible metal reinforcing material, and applying cement mortar thereover to cover the reinforcing material. The framework can be made of easily fabricated wooden ribs.

10 Claims, 9 Drawing Figures

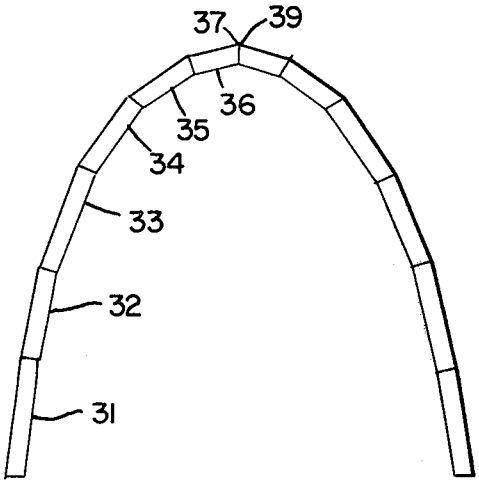
FIG. 2a
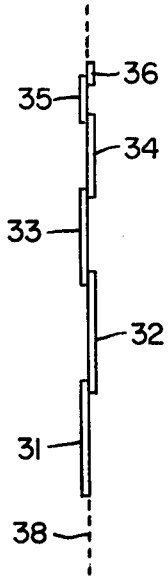
FIG. 2b
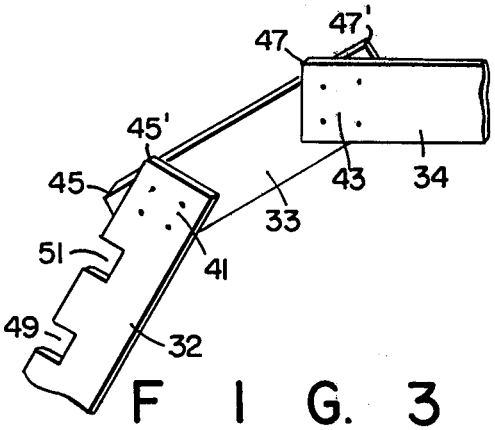
FIG. 3
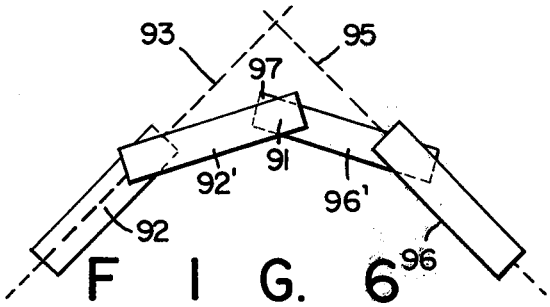
FIG. 6
FIG. 5
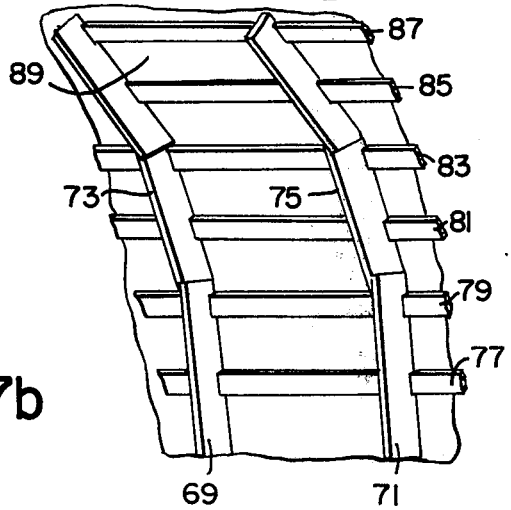
FIG. 7a
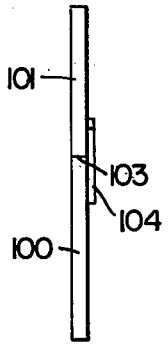
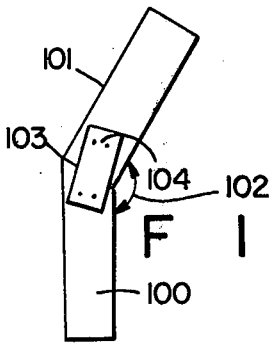
FIG. 7b

FERROCEMENT STRUCTURES AND METHOD

BACKGROUND

Ferrocement structures and various methods for producing them have been known for a number of years. Such structures have found uses not only as enclosures for use as commercial buildings and housing but also as hulls for boats and ships. Widespread use of ferrocement buildings has been limited to a large extent by the relatively inconvenient methods for producing them which have thus far been developed.

Illustrative of known ferrocement structures and methods are the following: U.S. Pat. No. 3,619,432 to Harrington discloses an inflatable form which is covered with reinforcing means and then cement. The form is deflated and removed after the cement has set. U.S. Pat. No. 3,118,010 to Harrington discloses the use of an inflatable form which is designed so that concrete can be applied to the inside surface of the form after it has been inflated. U.S. Pat. No. 3,462,521 to Bini discloses the application of reinforcing means and concrete over a collapsed, sheet-like, expandable form which is then inflated and expanded (while the concrete is still unset) into a dome-like structure. U.S. Pat. No. 2,948,047 to Peeler, et al., describes modular frame sections made of rods and covered with an open mesh (apparently metal) fabric to which cement is applied. U.S. Pat. No. 3,506,746 to Fontaine describes the use of a deformable mesh which is supported at some points and hangs freely at other points to give an irregular shape. Cement is applied over the mesh, and the supports and mesh are removed after the cement sets. U.S. Pat. No. 3,604,077 to Rath describes the manufacture of ferrocement boat hulls by injecting a concrete mixture into a mold. Recent practical applications of ferrocement constructions are discussed in "The Dome Builder's Handbook" edited by John Prenis, Running Press, Philadelphia, Pennsylvania, 1973, and "Ferrocement: Applications in Developing Countries", National Academy of Sciences, Washington, D.C., February 1973.

The present invention provides a simple and straightforward method of providing a wide variety of ferrocement structures which does not require the use of molds, inflatable or removable forms, the need to apply unset cement to the under side of a supporting structure, or any of the other relatively awkward steps present in prior art methods.

THE DRAWINGS

In the drawings:

FIG. 1 is a perspective view of a ferrocement structure of the present invention.

FIGS. 2*a* and 2*b* show, respectively, a side view and edge view of a preferred rib structure of the invention.

FIG. 3 is an enlarged view of a section of a rib structure of FIG. 2 showing details of its construction.

FIG. 5 is a perspective view of two ribs from the framework of FIG. 4 showing details of nailing edges and insulation space.

FIG. 6 is an enlarged perspective view of the apex of the arch formed by the two ribs of FIG. 2*a*.

FIGS. 7*a* and 7*b* show, respectively, an edge view and a side view of an alternative rib structure of the invention.

SUMMARY OF THE INVENTION

The enclosure of this invention comprises (a) a load-bearing framework defining the shape of the enclosure, at least a portion of the framework having a convex configuration; (b) at least one layer of moisture-impermeable flexible sheet-like material having an inside surface and an outside surface disposed over and supported by the framework, portions of such inside surface being in contact with the framework; and (c) a layer of cured cement mortar having reinforcing means therein disposed over and in contact with the outside surface of the sheet-like material, such reinforcing means comprising at least two layers of wire mesh embedded in the cement.

The method of this invention for constructing an enclosure comprises the steps of (a) providing a load-bearing framework defining the shape of the enclosure, at least a portion of the framework having a convex configuration; (b) applying over the framework at least one layer of flexible sheet-like material having an inside surface and an outside surface so that portions of such inside surface are in contact with the framework and the sheet-like material conforms to the shape of the framework, the sheet-like material having sufficient tear strength and impermeability to moisture to support the cement mortar mixture applied in step (d) hereinbelow; (c) applying over the outside surface of the flexible sheet-like material at least two layers of flexible wire mesh which conform to the shape of the sheet-like material and the framework, and (d) applying over the sheet-like material and over and around the wire mesh a wet cement mortar mixture in sufficient quantity to provide a substantially void-free layer of wet cement which completely covers the wire mesh.

In preferred embodiments of the invention (1) the total thickness of the reinforced cement shell is then than three-fourth's inch, thus providing a very light-weight structure, (2) the framework is made at least in part from arcuate ribs fabricated from short lengths of lumber, (3) the framework comprises a combination of ribs and stringers which can be walked on, ladder-like, when applying the sheet-like material and wire mesh, and (4) the application of successive small sections of sheet-like material and wire mesh to the special framework described in (3) above.

DETAILED DESCRIPTION

The present invention and preferred embodiments will now be described in greater detail, first with reference to the drawings and then by a discussion of individual structural features or method steps and specific illustrative examples.

Figure 1:
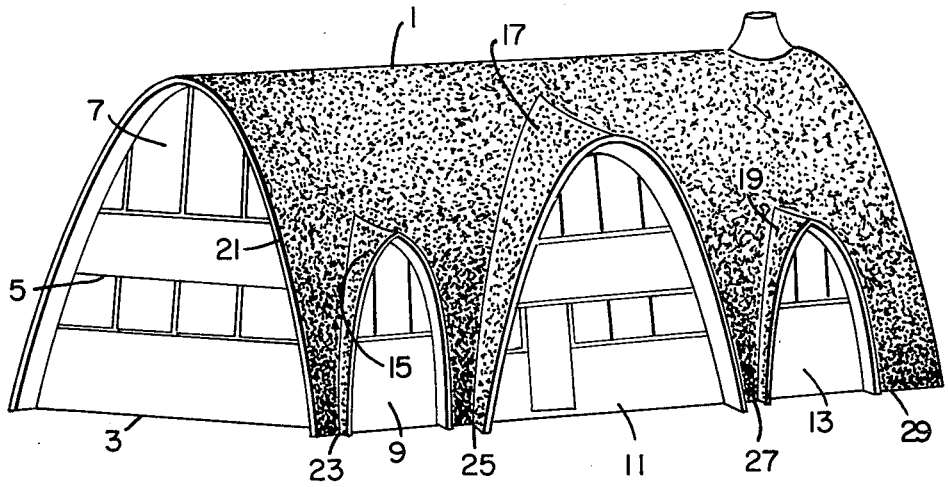

FIG. 1 shows a typical ferrocement structure of the present invention which includes a ferrocement shell 1 which is generally convex in configuration and encloses two levels of living space, 3 and 5. Window and door openings are disposed in the open end portion 7 and in openings 9, 11 and 13 cut into the supporting framework (not shown) prior to application of the ferrocement covering. Cowlings 15, 17 and 19, also constructed by the method of this invention, cover the openings in the sides of the structure. The cowlings carry only the weight of the ferrocement covering and thus are required to bear only a very small fraction of the load of the conventional window and door frame structures. The ferrocement portion of the structure of FIG. 1 could be terminated at approximately the conventional roof level 21 and could be provided with conventional leaders and gutters to provide drainage. However, an advantage of the present invention is that the ferrocement covering can be monolithic as shown in FIG. 1 with the ferrocement extending all the way to ground level, thus eliminating the need for conventional leaders and gutters. Runoff water, which will collect primarily around points 23, 25, 27 and 29 can be led away from the structure by conventional drains located at these points.

FIG. 2 illustrates a preferred rib structure for use in constructing load-bearing frameworks of the invention. As shown in FIG. 2*a* a typical rib comprises several sections 31, 32, 33, 34, 35 and 36, constructed from lengths of 1 × 4 inch boards which are joined together at their ends at angles such that the joined lengths approximate the shape of the desired arc and which are then shaped and trimmed at the outer corners to conform to the desired arcuate shape of the rib. FIG. 2*a* is an end view of the rib of 2*a* showing the staggered relationship of the short 1 × 4 inch lengths, 31, 32, 33, 34 and 35. Each length of lumber 32, 33, 34 and so on, forms a bridge between the preceding and succeeding length so that the total width of the rib does not exceed twice the thickness of the lumber. As is also shown in FIG. 2*a*, two typical ribs can be joined together at their apexes 37 and 39 to form a load-bearing arch. Dotted line 38 indicates the center line of the rib, to which further reference will be made hereinbelow.

The structure and method of fabrication of the ribs of FIG. 2 is shown in more detail in the enlarged rib section of FIG. 3. In FIG. 3, three lengths of 1 × 4 inch lumber 32, 33 and 34, are joined together at points 41 and 43 by nailing or other convenient means to conform generally to the desired arcuate shape of the rib of FIG. 2*a*. After nailing, the projecting corners 45, 45′, 47 and 47′ of the 1 × 4 inch lengths are trimmed to provide a smooth outer edge. Notches 49 and 51 can be cut at intervals in one or all of the individual rib lengths to accept stringers (not shown) which will tie together several of the ribs into an integral load-bearing structure, as is illustrated in more detail in FIG. 4.

Figure 4:
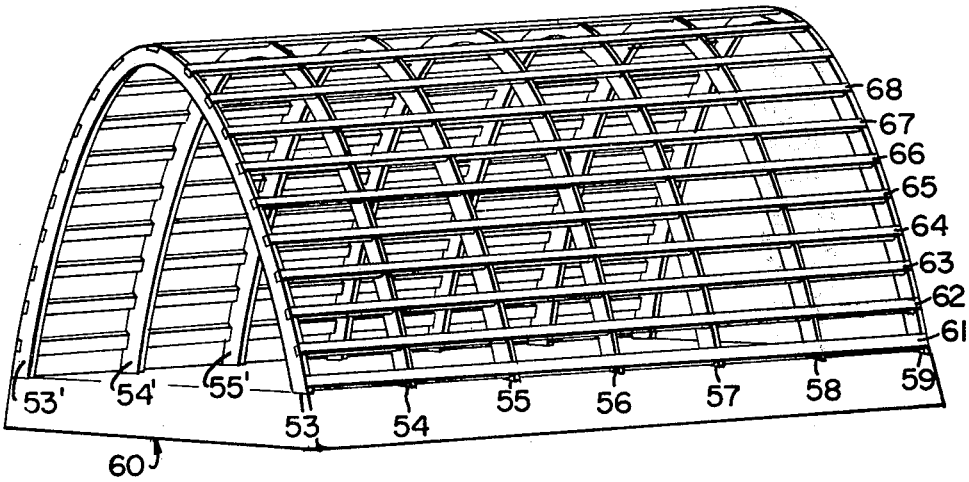
FIG. 4 is a perspective view of a framework of the present invention comprising ribs of the type shown in FIG. 2.

FIG. 4 shows a typical load-bearing framework of the invention which is made up of a series of ribs 53, 53′, 54, 54′, 55, 56, 57, 58 and 59, of the type shown in FIG. 2 (except that the individual short lengths of lumber making up each rib are not shown in FIG. 4) supported at the bottom on a base or foundation 60 and joined together at their upper ends to form a series of load-bearing arches and which are tied together into a rigid three dimensional framework by a series of horizontally disposed stringers 61, 62, 63, 64, 65, 66, 67, 68 and so on, inserted into notches of the type illustrated in FIG. 3 and nailed or otherwise fastened to the ribs to provide a rigid load-bearing framework. The stringers can be fabricated from 1 × 4 inch lumber split longwise to give 1 × 2 inch stringers. Thus, the 1 × 4 inch ribs and the 1 × 2 inch stringers can be fabricated from only one size lumber.

FIG. 5 illustrates two typical ribs 69 and 71, in a structure such as that shown in FIG. 4. The rib edges 73 and 75, are those facing the inside of the enclosure of FIG. 4. Inside wall comprises several stringers 77, 79, 81, 83, 85 and 87, beyond which is located the flexible sheet-like material 89 and other components of the ferrocement covering. In a preferred embodiment of the invention, the ribs 69 and 71 are spaced at intervals of 16 inches or 24 inches so that conventional insulation materials can be placed therebetween without cutting and shaping. The insulating material can be nailed to the 1 × 4 inch ribs in the same fashion as is done with conventional wooden structures which use 2 × 4 inch studs on 16 inch or 24 inch centers. Electrical wiring and fixtures can also be run through the rib structures as in conventional construction, and the inside edges 73 and 75 of the rib structures can be used as nailing edges for plasterboard, paneling, or other desired interior furnishing material. As shown in FIG. 2*b*, the individual short lengths of lumber are connected together in such manner that the alternate lengths fall on opposite sides of the center line 38, that is, sections 31 and 33 lie on one side of the center line, while section 32 which bridges 31 and 33 lies on the opposite side of the center line. When two ribs are joined together at their apexes, as shown in FIG. 2*a*, the two center lines preferably lie in a plane which is disposed perpendicularly to the base of the structure. (This configuration is shown in FIG. 6, discussed hereinbelow.) The center lines of the pairs of ribs 53–53′, 54–54′ and 55–55′ in FIG. 4 thus define a series of parallel planes each of which is perpendicular to the base 60 of the structure.

It is preferable to have the ribs joined at their apexes in the configuration shown in FIG. 6, that is with the apex 91 of one rib which includes rib sections 92 and 92′ on one side of the plane of the center lines 93 and 95 of the two ribs and the apex 97 of the second rib which includes rib sections 96 and 96′ on the opposite side of the plane. (Center line 93 as shown passes in front of section 92 and behind section 92′, while center line 95 as shown passes behind section 96 and in front of section 96′.) When forming part of a framework, it is also preferable to have the center lines of the rib structures uniformly spaced, for example at 16 inch or 24 inch intervals for easy installation of modular insulation batts, interior paneling and the like.

In an alternative embodiment of the invention, rib structures are constructed from short lengths of lumber butted together and fastened by means of a splice. This type of construction is illustrated in FIGS. 7*a* and 7*b*. The two pieces of lumber 100 and 101 are first cut to fit together along the desired angle 102. They are then placed together in abutting relation at joint 103 and fastened by means of a short splice 104 of wood or metal or other suitable fastener.

The present invention provides a unique combination of structural rib-work, sheet-like material, wire mesh and cement for use in the construction of low-cost, thin-shell, ferroconcrete structures in an almost infinite variety of curvilinear configurations. The ferroconcrete covers of this invention are relatively thin and lightweight and can eliminate the use of heavy reinforcing bars and heavy steel mesh entirely if desired. The present invention also eliminates the need of costly and cumbersome molds generally used in the construction of ferroconcrete structures. These molds had either been formed in wood, epoxy, fiberglass or inflated membranes, and due to their high cost and complexity had limited the variety of structural configurations that might have been desired. The present invention permits a greater flexibility of configuration, at a lower cost than possible with any system presently known.

Buckminster Fuller's geodesic dome structures, while very strong and relatively inexpensive, must remain basically hemispherical, offering no possibility of the excitement that comes from the more complex configurations possible with the system of this invention. Other such structures referred to as zomes, tension domes, etc., also offer limited possibilities for artistic expression due to their rigid mathematical conceptions. However, these structures (or their framework) could be covered economically with thin ferrocement shells. Builders of these domes have encountered difficulties in finding suitable coverings that would be inexpensive and weatherproof. A variety of materials have been used, ranging from vinyl films, urethane foam, treated canvas, fiberglass, and polyethylene to ordinary asbestos-tar roofing shingles. All of these coverings have had shortcomings and inadequacies of some sort; they either leaked, had too short a life span, were difficult to apply or were prohibitively expensive. Ferrocement "covers" of this invention could be used for these structures without the problems mentioned above. Also, porches and cowlings over doorways could be simply and economically constructed by the method of this invention, and ferrocement covers of this invention could be applied directly over existing roofs, creating durable life-time roofs. These covers could be monolithic, having no joints and extending out to form gutters co-extensive with the roof shell.

In the method of this invention, the structural framework is covered by a sufficiently strong moisture-impermeable sheet-like material, followed by an application of at least two and preferably four to five layers of a relatively supple wire mesh, thus forming, all at once, the "mold" and the structural reinforcing media of the concrete shell. A rich cement mortar consisting of A-1, air-entrained Portland cement, masonry sand and water is then rubber or vibrated thoroughly into the wire mat and troweled to the smoothness or texture desired. After a sufficient time of "damp curing" the main construction process is complete and the result is a very thin but strong and durable ferroconcrete structure. The sheet-like material is an essential part of the construction process as it serves as a cement mortar retainer, preventing the cement mortar from being pushed through the wire mesh during the plastering operation or falling through afterward. It also eliminates the need for plastering from both sides by skilled plasterers as is done in boat construction and attempted by some dome builders.

The concrete shells constructed by the method of this invention are generally only one-half inch thick and rarely exceed three-fourths of an inch in thickness, thus requiring mush less cement than previously used in buildings of comparable format. Boat hulls generally range from three-fourths inch to 1 inch in thickness, use a heavier gauge wire with a tighter mesh and use more layers in building up a mat of reinforcing material than are required in the present invention. While these boats require such additional reinforcement to withstand the flexing and pounding forces encountered at sea, such construction methods would be overbuilding for most land based structures designed for conventional use as shelters of various kinds. Nevertheless, the literature on reinforced concrete and ferroconcrete structures is replete with descriptions of structures built utilizing great quantities of steel reinforcing bars and heavy steel mesh for buildings of relatively small size. These shells often range from 1½ inches to 3 inches in thickness, and are much more complicated and costly than the shells of this invention.

STRUCTURAL FRAMEWORK

The loadbearing framework of this invention can be constructed from a wide variety of materials, for example, curved metal tubing, conventional steel reinforcing rods (rebars) about one-fourth to one-half inch in diameter and bent to give the desired configuration, pieces of plywood cut to the desired curvatuve and supported by conventional 2 × 4 inch pillars, and the like. Saplings, bamboo and other flexible natural materials can also be used in the construction of the framework.

A preferred framework of this invention consists of ribs fabricated, as described above with reference to FIGS. 2 through 7, of 1 × 4 inch boards of varied lengths ranging generally from 2 to 4 foot lengths and rarely exceeding 5 feet. These short lengths of board are joined together consecutively and alternately by nailing with overlaps of about 6 inches at the joints, to form as closely as possible the arcs desired. Shorter lengths are required to form arcs of smaller radii. Longer boards are used where the desired arcs have a wider radii and also at the base of the arcs where they will rise almost vertically for several feet creating more headroom inside a typical structure. At the points of the arch where the individual lengths of boards are joined by overlapping and nailing, the corners of the overlapping board which protrude outside the curved line must be chamfered or trimmed to correspond with the desired curvilinearity of the outer edge of the desired arc. These simple "laminations" can be easily constructed following a preconceived graph design transferred to full scale on any flat surface.

The short pieces of lumber used to constrct the ribs can be fastened by nails as shown in FIG. 3, but bolts, wood glue, or other adhesive can be employed. The use of at least two bolts at each joint makes it possible to remove all but one bolt from each joint and then fold up the short rib sections using the bolt as a pivot, thus making it possible to prefabricate the ribs in one location and transport them in folded condition to the site where they will be used in constructing the framework, the remaining bolts being replaced at the site.

The ribs thus constructed are very strong elements in the total structure as they are erected vertically with the boards on edge, the compression forces acting downward through their strongest section and not laterally, thus preventing the nailed joints from pulling apart or the board themselves breaking. These curved ribs in combination with other ribs form the inner and outer configuration of the structure and acting in consort give the total framework great stability and strength. They may also be "tied" together by long horizontal stringers made of 1 by 2 inch strips of wood. (These stringers may be made of lighter material where bending is required to approximate more closely the curvature required of some complex curvilinear surface.) The stringers are nailed to the ribs inside of pre-cut notches on the outer surface or edges of the ribs at intervals of approximately one foot. The stringers thus placed will serve admirably as "ladders" or scaffolding during later stages of construction.

The curved ribs can vary in size (span and height) as well as shape, and they can be arranged to determine a great variety of configurations. Arranged in rows, a barrel vault shape is created as in FIG. 4; half-ribs arranged in a circle and joined at their apexes result in a dome. In constructing such domes where a relatively large number of individual ribs are involved, it is not always possible to join the ribs directly at the apex of the structure, in which case it is preferable to use a yoke in the form of a circle or other shape at the top of the dome structure to which the apexes of the individual ribs are attached. The opening in the center of the yoke can be covered with a ferrocement shell supported by a few pieces of lumber across the opening in the yoke or can be fitted with a transparent or translucent glass or plastic material and used as a skylight. The versatility of this system makes it possible to design an infinite number of structural configurations.

The ribs may be erected to stand on either 2 foot or 16 inch centers. This makes it possible to use standard insulating materials (fiberglas) between them as these insulating materials come in those modules. Where the ribs converge toward the apex as in some very irregular configurations or as in a dome, the insulation must be cut to conform with the space. The 4 inch depth of the ribs also makes it possible to run electrical conduits through them. The interior edges of the ribs will also support wire lath for plastering and in the less curved areas may serve as nailers for plyboard, sheetrock and other pliable materials, if so desired. Insulating plaster and insulating foams, such as urethane foam, can also be used as or in conjunction with interior finishing materials. The foam is particularly suitable in that it can be sprayed on to the interior surface of the framework and left in its natural color or painted.

SHEET-LIKE MATERIAL

Almost any strong, durable, moisture-impermeable flexible sheet-like material can be employed, especially the many readily available plastic films. The term "moisture-impermeable" as used herein means that the inside surface of the sheet-like material (except where it has been punctured by staples, protruding points on wire mesh, wire loops used to tie the mesh, and the like) is not wet by water penetrating through the material from wet cement mortar in contact with the other surface of the sheet-like material. For example, film such as 4 or 5 mil. polyethylene can be used if it is supported underneath by a single layer of wire mesh to prevent excessive sagging under the pressures of plastering and the weight of wet cement mortar itself. However, to realize a greater economy in both labor and cost of materials, a single film strong enough not to sag or tear without an underlying, supporting wire mesh should be used. Examples of such preferred, very strong plastic films are (1) a woven fabric of high density polyethylene, coated on both sides with polyethylene, 10 mils. thick with a tensile strength of 142 lbs. per lineal inch in the warp and 109 lbs. per lineal inch in the fill, and available under the trade name of Loretex, and (2) a commercially available film of woven nylon and polyethylene. Both of these films are very strong, moisture impermeable and relatively inexpensive. Any of the above described sheet-like materials may be stapled directly to the wooden rib framework with an ordinary stapler of the variety used to staple ceiling tiles to furring strips in home construction.

In a preferred embodiment of the invention, the proper sequence in the application of the sheet-like material and the wire mesh (which follows) permits the builder to avoid the necessity of using scaffolding. The ribbed framework of the type shown in FIG. 4 can be walked on "ladder-like" thus eliminating the need of scaffolding if it is not first totally covered by the sheet-like material. The proper sequence of the application of the sheet-like material and the wire mesh is to start at or near the top of the structure, applying first a manageable (relatively small) swatch or two of sheet-like material and then following with the desired number of strips of wire mesh to cover each swatch of sheet-like material, continuing in this manner, working downward and outward, overlapping the edges of each successive swatch of sheet-like material and wire mesh, until the whole structure is covered with sheet-like material and sufficient wire mesh to make a mat of the desired thickness. (Generally five layers of wire is adequate for most purposes.) This sequence also prevents the sheet-like material from being exposed to unnecessary pressures encountered in construction, which in spite of its toughness could cause it to tear or sag. The sizes of sheet-like material as well as wire swatches applied will vary with, and will be determined by the complexity and circumferences of the surfaces to be covered. Smaller patches of sheet-like material and wire mesh must be used to cover very complex, asymmetrical surfaces of small circumference if excessive folding and crimping is to be avoided. Longer and wider strips may be used when the configuration is simple and plain as, for example, in the barrel vault of FIG. 4 or in large domes. Once the structure is completely covered with the sheet-like material and multiple layers of wire mesh, it can be walked on and will support the weight of the persons applying the cement mortar mixture.

Where a relatively open framework is employed, for example, spaced steel rods, the sheet-like material has a tendency to sag particularly under the weight of wet cement mortar. This is easily taken care of by placing a single layer of wire mesh, particularly a relatively stiff mesh such as hog wire, directly over the bars or other rib forming material defining the framework, and the wire mesh then provides adequate support for the sheet-like material. In this structural embodiment, the wire mesh directly in contact with the supporting ribs forms a part of the load-bearing framework.

The framework of the type shown in FIG. 4 and which is constructed from wooden ribs and stringers, is particularly advantageous in that it provides a surface to which the flexible sheet-like material and layers of wire mesh can be nailed or stapled. The use of conventional staple guns is most convenient and avoids the necessity of typing down the layers of wire mesh by means of pieces of wire which is often required where, for example, steel reinforcing bars are used to construct the framework.

REINFORCING WIRE MESH

The wire mesh to be used as the reinforcing body of the ferrocement shells of this invention must be flexible, strong, inexpensive and readily available. Ordinary chicken wire with an octagonal, one inch diameter mesh satisfies all of these requirements, although other flexible wires, such as hog wire and other conventional fence wires can be used. Chicken wire is preferred and can be stretched tautly over the framework to generally conform to all but the most complex and irregular surfaces encountered in this type of construction. Various sized swatches of wire mesh are used to facilitate both handling and its application to the curved and irregular surfaces. Chicken wire mesh comes in rolls of various lengths and widths. It may be had in 3, 4, 5, and 6 ft. widths in rolls up to 150 ft. long. It has been found that the 4 ft. width is best for general all-around purposes and for ease of handling.

Swatches of wire mesh are cut from the roll that may range from 6 to 15 ft. depending on the complexity of the surface to be covered. Much longer strips may be used where the surface is relatively plain and flat. The wire is applied more of less randomly (over the sheet-like material), starting from the top of the structure and working downward and outward. Some overlapping of wire will occur but bending and crimping the wire should be avoided as much as possible because this could result in lumps sticking up above the prevailing surface of the wire mat. At points where the wire swatches terminate, sticking up, without rib edges or stringers to which to staple, the wire mesh must be "wire-tied" down to the underlying layers. This is done by forming a U shaped wire from a single length of thin utility wire and pushing the two ends down through the plastic film and twisting the two ends together underneath. All other stray wire ends should be twisted and tied down to the prevailing level of the wire mesh mat. When the wire mesh mat is uniformly built up to four or five layers the structure is ready for cement mortar plastering.

CEMENT MORTAR PLASTERING

A rich mortar consisting of, for example, one part Type A-1, air entrained Portland cement, 2½ parts masonry sand and enough clean water to make the mixture somewhat plastic but not too wet, is prepared by mixing thoroughly in a mortar mixer. This mortar may be conveyed to the top of the structure via bucket brigade cement mortar pump or other contrivance. Plasterers then rub, press and otherwise vibrate the mortar thoroughly into the wire mesh mat, leaving no voids, high spots or exposed mesh. This plastering is generally best done manually, the plasterers wearing protective gloves. Finishing may be done with steel trowels where a smooth finish is desired. The additional compression of troweling may also be desirable for the added density it imparts to the finished concrete.

The concrete shells created in this manner are very thin, rarely exceeding three-fourths inch but generally being only one-half inch thick throughout. The reinforcing wire mesh itself is covered with generally no more than one-eighth to one-fourth inch of cement mortar. Curing the cement is done by a standard procedure of keeping it moist by covering with a plastic film for 7 days or more.

An advantage of the present invention results from the moisture impermeability of the flexible sheet-like material, which together with the mesh, supports the cement mortar shell. Adequate curing of the freshly applied cement mortar usually requires a substantial period of time of as many as seven days or more during which time the cement mortar must be kept damp. In prior art methods, the wet cement mortar had to be covered with a moisture retaining cover such as a plastic sheet on the outside surface and frequently wet down on the inside surface to prevent premature drying. In the present invention, it is unnecessary to wet or otherwise treat the inside of the ferrocement structure during the curing process. The moisture impermeable sheet-like material retains water in the freshly applied cement mortar and permits it to dry slowly, the occasional application of water and use of a cover being required only on the external surface.

WATERPROOFING

Set cement mortar itself is not generally waterproof. It has been found that commercial masonry paints waterproof these structures quite adequately, and are relatively inexpensive, durable and readily available. These paints are applied with a stiff brush, generally in two coats with a specified drying time between each coat.

WINDOWS AND DOORS

Windows, doors (and interior partitions, when desired) can be easily fabricated to fit into the structures of this invention. Window and door frames are generally built or pre-fabricated during construction of the load-bearing framework. These window and door frames can be made of materials lighter than those required in ordinary construction since there are no compression forces acting downward on the arched spans of these openings in the shell. The cowlings over door and window openings, such as 15, 17 and 19 shown in FIG. 1, can be supported by arches constructed from pairs of ribs following the same general configuration as the vault structure of FIG. 4.

STANDARDIZED MATERIALS

It is to be noted that all of the materials used in the preferred embodiments of this invention are simple and readily available in most lumber yards or building supply stores. There are no exotic elements required in the construction of these structures or specialized skills that would prevent the amateur builder with only rudimentary knowledge of carpentry or masonry from building these structures.

The structural materials are all standardized, all the framing is done with lumber of one dimension: 1 inch by 4 inch boards. This same material may be ripped in half to make the 1 × 2 inch stringers. For tall structures or other instances where the framework must carry a significant weight 1 × 6 lumber can be used in constructing the ribs and stringers, that is, short lengths of 1 × 6 lumber are used to construct the ribs and longer pieces of 1 × 6 lumber cut lengthwise provide 1 × 3 stringers. The light weight of the rib sections makes them easily portable to the building site. They can either be prefabricated and hauled to the site, partially pre-built or their unassembled components hauled to the site and totally assembled there. This portability of the basic structural components in this system is also a very real advantage in construction. Window frames (both vertical and horizontal elements) may be made of the same material. Only door frames need to be constructed of heavier lumber, and here standard 2 × 4 inches will suffice. The simplicity of the system of construction of this invention is a very real breakthrough in the construction of economical ferrocement enclosures for a wide variety of uses.

The following detailed examples further illustrate the invention.

EXAMPLE 1

A ferro-cement structure (house) of this invention was built over a frame of ½ inch steel reinforcement bars. The frame was tacked to a conventional cement block basement, 30 × 50 feet, and spot welded in various areas to make the re-bars more rigid. The semi-rigid frame was supported by 1 to 2 in. diameter saplings. Four mil. polyethylene plastic was stretched over the frame to retain the cement mixture while setting. A layer of large mesh hog wire (2–4 in.) was used on the inside to assist shaping, give the plastic a base to which it could be stapled, and support it while retaining the wet mortar, as it had a tendency to sag from the weight.

The first step in constructing the frame was to form the arcs, which were to define the basic exterior shape and serve as window openings and cowlings over the windows and doors. These were first set in place, then attached by long arched re-bars to a very crude "yoke" or center ring atop a 14 ft. pole in the center of the floor. Basically, the frame construction was a matter of supporting the preformed window arcs by running the long re-bars to the center ring, which gave form to the arched roof. Improvising and logical placement, together with a general idea of the desired shape, led to the finished product.

The large mesh hog wire was attached by "wire tying" it to the interior of the frame. The plastic was laid over the top of the frame and stapled from underneath to thin slats of masonite and plywood. These slats were also used to tighten the chicken wire and keep it within ½ in. thickness. Many spots had to be hand tied to re-bars with 5–6 in. long wire loops (utility wire) to bring down the bumps.

The cementing was done in one day, with the exception of ridges and areas under the cowlings. Two cement mixers were used and a crew of about twenty. The completed structure was a very unique free-form ferrocement "dome". The cost of this house was one-third less than a conventional house of the same size, even though all other aspects of building (electricity, plumbing, heat, etc.) were done in a conventional manner.

EXAMPLE 2

A small ferrocement barrel-vault storage shelter of these dimensions: height 7 feet 2 inches, width 11 feet 4 inches and length 15 feet were constructed in the following manner.

The foundation consisted of a 4 inch thick slab of reinforced concrete poured over a rock fill consisting of very large rocks extending down below frost level (2½ feet) and smaller rocks and gravel covering this and extending upward immediately below and forming a bed for the poured concrete slab. This method was selected because of special drainage problems in a very wet site. Usually a standard perimeter foundation extending down below frost level would be built and the ferrocement structures erected upon it as would any standard building.

A simple plan drawn on graph paper was made to determine the overall design of the structure regarding height and width ratios (span of the arcs) and the lengths of the straight segments which would form the curved surfaces of the arcs. This plan was transferred to a full scale graph of 1 foot squares made by snapping a carpenter's chalk line on the concrete slab upon which the structure was to be built. The length of the wooden segments (1 × 4 inch boards) comprising the ribs of the structure were determined by the circumference of the arcs. It was found that this structure, a barrel-vault of relatively small dimensions, could be most economically built by using very short segments of lumber.

Ribs of the type shown in FIG. 2 were made by overlapping and nailing 1 × 4 inch sections of wood, each section 20 inches long. A sufficient number of ribs were made to accommodate the length of the building, the ribs being spaced on 16 inch centers. The ribs were then stacked together, side-by-side and notches were cut to accommodate the horizontal stringers. This was done by setting a skil-saw to the appropriate blade depth (three-fourths inch) and cutting out the premarked spaces at 1 foot intervals.

A supply of 1 × 2 inch stringers were prepared by ripping 1 × 4 inch boards.

This being completed, two arched ribs were erected at either end of the slab by tacking temporary braces to stakes driven into the ground and to the tops of the two arches formed by these four ribs. The bases of the arches were set back (three-fourths inch) from the outer edges of the slab to accommodate the wire reinforcing mesh which was to be applied. Two horizontal stringers were nailed into the pre-cut notches at the bases of the arches. Two more stringers, one on either side, were nailed at approximately two-thirds of the height of the structure. This insured stability while the remaining arches were filled into their prescribed spaces. More horizontal stringers were nailed to the arches starting from the bottom on either side of the structure. These stringers could be walked on ladder-like as one ascended nailing additional stringers to the structure.

When all the stringers were in place, the framework was adequately rigid and ready for the application of plastic sheet. A 15 × 6 feet strip of Loretex was placed on the top, stapled at one end of the structure and stretched and stapled the length of the structure. A 4 × 15 foot piece of 1 inch mesh chicken wire was likewise applied over the plastic sheet. Two more lengths of chicken wire were applied this time overlapping to give a density of three layers at the apex of the structure. Additional strips of plastic film and chicken wire were applied, working downward until the whole structure was covered tautly and uniformly with four layers of wire.

The application of the Portland cement (No. 1-A Air Entrained) mortar followed. Using ladders placed against the structure, the cement mortar was conveyed in buckets to the top of the structure, dumped and thoroughly rubbed into the wire mesh by plasterers wearing vinyl gloves. The plastic sheet and wire mesh over the wooden framework was sturdy enough to be walked upon and knelt on by the plasterers without causing significant deformity to the reinforcing wire mesh or the plastic sheel mortar retainer underneath. The plastering proceeded from the top downward and outward until the whole structure was covered with no more than three-fourths inch of cement and with no reinforcing wire exposed. To prevent a too hasty drying of the wet mortar a plastic film was applied over the plastered areas as the work progressed. The whole structure was thus covered when the plastering was completed. The plastic sheet underneath the cement precluded the too hasty drying on the underside of the structure. The plastic film covering the top of the structure was retained for 1 week, the minimum "curing" time for concrete.

The cured structure was washed on the outside surface with mureatic acid, rinsed thoroughly with water, allowed to dry, and then painted with two coats of waterproofing masonry paint.

One end (rear) of the structure was built against a poured concrete retaining wall which also serves as the back wall of the structure. The other end (front) of the structure was left open pending determination of the type of equipment or supplies to be stored, and a door of appropriate width will be added at a later date.

EXAMPLE 3

A second storage shelter was built which was the same as the shelter of Example 2 except for its size and rib construction. The ferrocement barrel-vault storage shelter of this Example 3 was 7 feet 2 inches high, 8 feet wide and 12 feet long. Ribs were constructed from 13 inch long segments of 1 × 4 inch wood cut at uniform angles to form butted joints of the type shown in FIG. 7. The cut ends were butted together and fastened by nailing 7 inch long 1 × 4 inch splices across the butted joints.

Notching of the ribs and all other steps in construction of the final shelter were carried out in the same manner as described in Example 2 hereinabove.

What is claimed is:

1. An enclosure comprising:

a. a load-bearing framework defining the shape of said enclosure, at least a portion of said framework having a convex configuration;

b. at least one layer of moisture-impermeable flexible sheet-like material having an inside surface and an outside surface disposed over and supported by said framework, portions of said inside surface being in contact with said framework; and c. a layer of cured cement mortar having reinforcing means therein disposed over and in contact with the outside surface of said sheet-like material, said reinforcing means comprising at least two layers of wire mesh embedded in said cement.

2. An enclosure in accordance with claim 1 wherein said layer of cured cement mortar is less than three-fourths inch thick.

3. An enclosure in accordance with claim 1 wherein the said framework is at least in part constructed from arc shaped ribs, said ribs comprising lengths of lumber joined together at their end portions so that such lengths follow approximately the shape of said arc.

4. An enclosure in accordance with claim 1 wherein said framework includes a plurality of arc shaped ribs, said ribs comprising lengths of lumber joined together at their end portions so that such lengths follow approximately the shape of said arc and wherein each length of lumber in an individual rib forms a bridge between the preceding and succeeding length so that the total width of said individual rib does not exceed twice the thickness of said lumber.

5. An enclosure in accordance with claim 4 wherein each joint is secured by at least two bolts such that when all but one of said bolts is removed from each joint said rib is foldable at each such joint using the single bolt as a pivot.

6. An enclosure in accordance with claim 1 wherein said framework comprises a plurality of rib structures as defined in claim 4 and wherein said rib structures are joined together by horizontally disposed wooden stringers fastened into notches in the outer edge of said ribs so that the outside edges of said ribs and said stringers define the shape of said enclosure.

7. A method for constructing an enclosure which comprises the steps of:

a. providing a load-bearing framework defining the shape of said enclosure, at least a portion of said framework having a convex configuration;

b. applying over said framework at least one layer of flexible sheet-like material having an inside surface and an outside surface so that portions of said inside surface are in contact with said framework and said sheet-like material conforms to the shape of said framework, said sheet-like material having sufficient tear strength and impermeability to moisture to support the cement mortar mixture applied in step (d) hereinbelow;

c. applying over the outside surface of said flexible sheet-like material at least two layers of flexible wire mesh which conforms to the shape of said sheet-like material and said framework; and d. applying over said sheet-like material and over and around said wire mesh a wet cement mortar mixture in sufficient quantity to provide a substantially void-free layer of wet cement mortar which completely covers said wire mesh.

8. The method in accordance with claim 7 wherein at least four layers of said wire mesh are applied.

9. The method in accordance with claim 8 wherein said sheet-lie material and said wire mesh are applied alternately by the steps of: disposing a swatch of said sheet-like material over said framework at a relatively elevated portion thereof, applying one or more layers of said wire mesh over said swatch of sheet-like material, applying additional swatches of sheet-like material adjacent to and overlapping the said first swatch, applying over said additional swatches of sheet-like material one or more layers of wire mesh overlapping the wire mesh covering said first swatch, and continuing in like manner until said entire enclosure is covered by said overlapping swatches of sheet-like material and overlapping wire mesh.

10. A method for constructing an enclosure as claimed in claim 7 wherein a load-bearing framework is provided which comprises a plurality of rib structures as defined in claim 4 and wherein said rib structures are joined together by horizontally disposed wooden stringers fastened into notches in the outer edge of said ribs so that the outside edges of said ribs and said stringers define the shape of said enclosure.

* * * * *

UNITED STATES PATENT OFFICE

CERTIFICATE OF CORRECTION

Patent No. 3,932,969 Issue Date January 20, 1976

Inventor(s) Thad E. Matras

It is certified that error appears in the above-identified patent and that said Letters Patent are hereby corrected as shown below:

Col. 2, line 40: "then" should read -- less --.

Col. 3, line 22: "2a" should read -- 2b --.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*